United States Patent [19]

Putz

[11] 4,008,988

[45] Feb. 22, 1977

[54] ROTARY PISTON EXPANSIBLE CHAMBER DEVICE

[76] Inventor: A. Frank Putz, 401 N. 89th St., Wauwatosa, Wis. 53226

[22] Filed: Dec. 16, 1974

[21] Appl. No.: 533,332

[52] U.S. Cl. ..... 418/54

[51] Int. Cl.[2] ..... F04C 1/02

[58] Field of Search ..... 418/54, 58, 61 R, 61 A, 418/61 B

[56] References Cited

UNITED STATES PATENTS

| | | | |
|---|---|---|---|
| 1,340,625 | 5/1920 | Planche | 418/54 |
| 1,636,486 | 7/1927 | Planche | 418/54 |
| 1,802,887 | 4/1931 | Feyens | 418/54 |

FOREIGN PATENTS OR APPLICATIONS

| | | | |
|---|---|---|---|
| 6,735 | 1834 | United Kingdom | 418/54 |

*Primary Examiner*—C. J. Husar
*Assistant Examiner*—Leonard Smith
*Attorney, Agent, or Firm*—Lee H. Kaiser

[57] ABSTRACT

A rotary piston expansible chamber device without phasing gears has a crankshaft whose axis is offset from the center of the closed curve defining the working chamber cross section and a rotary piston operatively connected to the crankshaft through a crankarm so that crankshaft and piston rotate together in a one-to-one ratio and the rotary piston is displaced as it revolves to maintain arcuately spaced apices thereon in continuous sliding and sealing engagement with the working chamber walls and vary first and second expansible chambers formed on opposite sides of the rotary piston from minimum to maximum and back to minimum during each revolution of the crankshaft. The crankarm constitutes sole force transmitting means between crankshaft and rotary piston, and the rotary piston is displaced as it rotates so that a straight line connecting the arcuately spaced apices remains perpendicular to a reference diameter through the center of the closed curve defining the working chamber cross section in all positions of the rotary piston.

44 Claims, 21 Drawing Figures

12
24
16
22
16
CS
CA
CP
R
FL1
31
37
FL2
39
33
35
F
39
33
35
D
10
E
14
17
I
11

24
C
CS
12
16
22
CA
16
14
10
C1
C2
11
CP
R
17

E
F
17
14
FL1
C2
A
31
C
35
C1
R
FL2
I
D

50
E"
I"
17"
CS"
60
66
62
64
35"
F
R"
R4
56
R3
57
55
35"
D
52

CS"
74
73
68
56
50
75
70
17"
57
66
R"
72
60
52
71
55
62
53
67
70

ROTARY PISTON EXPANSIBLE CHAMBER DEVICE

This invention relates to rotary piston expansible chamber machines and in particular to rotary piston expansible chamber devices of the continuous apex contact type wherein a piston rotating within a cylindrical working chamber is repositioned relative to the surrounding internal walls defining the working chamber to vary the volume of the working chamber.

BACKGROUND OF THE INVENTION

Rotary piston expansible chamber devices of the continuous apex contact type are known having arcuately spaced apices defining a plurality of expansible chambers as exemplified by the internal combustion engine popularly referred to as the Wankel engine, but such devices require special machinery and equipment to machine the epitrochoidal bore which forms the working chamber and need phasing gears to maintain the proper phase relationship between rotary piston and eccentric shaft in order to control the orbital motion of the rotary piston relative to the working chamber. Continuous apex contact rotary piston expansible chamber devices are also known of the type disclosed in such U.S. Pat. Nos. as 1,340,625 and 1,636,486 to LaPlanche wherein the rotary piston of a pump is spindle-shaped in cross section and has arcuately spaced apex seals and the bore cross section is a conchoid, but such devices require higher shaft speed than rotary piston speed and need a combination of gears to maintain the proper phase relationship between rotary piston, shaft and bore.

OBJECTS OF THE INVENTION

It is an object of the invention to provide an improved rotary piston expansible chamber device having novel motion transmitting means which maintains continuous sealing engagement between a rotary piston having arcuately spaced apices and the working chamber surface as the rotating piston is repositioned within the working chamber without the necessity of phasing gears required in prior art structures. It is a further object of the invention to provide such an improved rotary piston expansible chamber device having a novel working chamber surface which is so generated geometrically that continuous sealing engagement is maintained between the rotary piston apices and the working chamber surface as the rotating piston is displaced to vary the volume of a plurality of expansible chambers. A still further object is to provide such an improved rotary piston expansible chamber device having novel motion transmitting means which maintains continuous sealing engagement between the working chamber surface and the apices of a piston which simultaneously rotates and reciprocates and with substantially no radial displacement of the apex seals. Another object is to provide such an improved rotary piston expansible chamber device wherein a crankarm is the sole force transmitting means between shaft and rotary piston and the working chamber surface is in continuous sealing engagement with the rotary piston apices and cams the rotary piston as it rotates so that it varies the volume of a plurality of expansible chambers between maximum and minimum and back to maximum during each revolution of the shaft. A still further object is to provide such an improved rotary piston expansible chamber device having a crankshaft eccentric to the center of the curve which defines the working chamber cross section and novel motion transmitting means which constrains the rotating piston so that arcuately spaced apices thereon remain in continuous sealing engagement with the working chamber surface and a straight line connecting such apices remains perpendicular to a reference diameter through the center of the working chamber cross section curve in all positions of the rotary piston. Still another object is to provide such an improved rotary piston expansible chamber device wherein novel motion transmitting means constrains the piston as it rotates so that the geometric center of its cross section reciprocates along the reference diameter through the center of the working chamber cross section curve to thereby vary the volume of first and second expansible chambers formed between the rotating piston and the working chamber surface. A still further object is to provide such an improved rotary piston expansible chamber device wherein the shaft and rotary piston rotate in a one-to-one ratio and the flanks of the piston closely approach the working chamber surface so that high compression ratios can be obtained. Still another object is to provide such an improved rotary piston expansible chamber device which is simpler in construction and has fewer parts than prior art structures and wherein the working chamber surface does not require special machinery and equipment to machine.

Summary of the Invention

A rotary piston expansible chamber device has a housing with a cylindrical bore, a cylindrical rotary piston having arcuately spaced first and second apices rotatable within the bore, a shaft rotatable within the bore, means including a force transmitting member carried by the shaft for operatively connecting the shaft to the rotary piston so that they rotate together in a one-to-one ratio while permitting movement of the rotary piston relative to the shaft, and means for displacing the rotary piston as it revolves so that, without the necessity of phasing gears, the first and second apices remain in continuous sliding contact with the bore in all positions of the rotary piston and form first and second variable volume chambers in opposite sides thereof which inversely vary in volume from minimum to maximum and back to minimum during each shaft revolution and also so that a straight line connecting the first and second apices remains perpendicular to a rotatable reference diameter through the center of the closed curve defining the bore cross section in all positions of the rotary piston within the bore. In a preferred embodiment of the axis of the shaft is offset from the center of the closed curve defining the bore cross section, the force transmitting member is a crankarm integral with the shaft and pivotally coupled to the rotary piston at a point radially outward from the geometric center of the rotary piston cross section, and the means for displacing the rotary piston include the first and second apices in sliding contact with the bore so camming the rotary piston that its geometric center reciprocates along the reference diameter as it rotates together with the shaft to thereby vary the volume of the first and second chambers.

DESCRIPTION OF THE DRAWINGS

These and other objects and advantages of the invention will become more apparent from the following detailed description when considered together with the accompanying drawings wherein.

DETAILED DESCRIPTION

Figure 5:
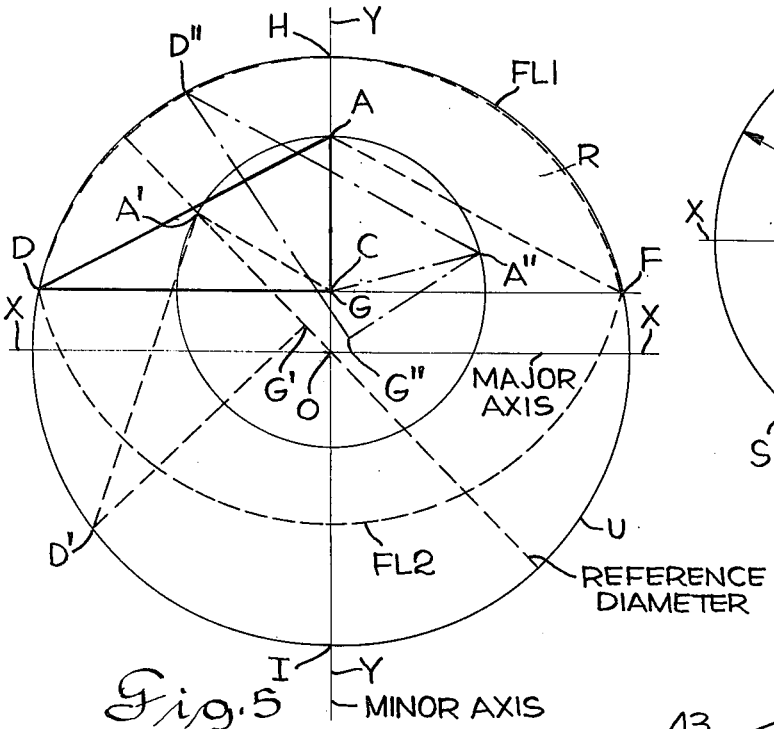
FIG. 5 illustrates the development of the cross section of the bore of a rotary piston expansible chamber device embodying the invention and shows three different positions of an imaginary triangle ADG, A'D'G' and A''D''G'' in full, dashed and dash-dot lines respectively.

Referring to FIGS. 1–4 of the drawing, a positive displacement, rotary piston pump embodiment of my invention has a housing 10 comprising end sections 11 and 12 and an intermediate section 14 interposed between end sections 11 and 12 and held firmly therebetween by a plurality of screws (not shown). The screws extend through aligned clearance holes in end section 11 and intermediate section 14 and into threaded holes 16 in end section 12 and retain the three sections 11, 12, 14 together to form a unitary housing 10. Intermediate section 14 has an axially extending internal cylindrial working chamber, or bore 17, a radially extending fluid inlet port I communicating with bore 17, and a radially extending fluid discharge port E communicating with bore 17. The term "bore" is used hereinafter in the description and appended claims to connote an internal cylindrical cavity, or working chamber in the housing irrespective of the method by which it is formed and irrespective of whether it is defined by the internal wall of the housing or in a separate member movable within the housing as in the embodiment of FIGS. 15 and 16. The cross section of bore 17 is a closed curve U (see FIGS. 4 and 5) which may be defined relative to rectangular coordinate axes X and Y and whose center is at the origin O defined by the intersection of axes X and Y. The closed curve U defining the bore cross section may be circular as shown in FIGS. 1–4 or generally elliptical as shown in FIG. 5 and described in detail hereinafter. End section 12 has a circular compartment 22 therein communicating with bore 17 whose axis is parallel to the axis of bore 17 but offset along axis Y from the intersection of axes X and Y so that compartment 22 is eccentric to bore 17. End section 12 also has a cylindrical opening 24 coaxial with compartment 22 in which a cantilevered, or overhung crankshaft CS is rotatably journalled so that it is eccentrically supported relative to bore 17. Crankshaft CS has a circular crankarm CA coaxial therewith carrying a crankpin CP disposed radially outward from and parallel to the crankshaft axis C.

A rotor termed a rotary piston, or displacement body R positioned within bore 17 for rotation therein is lenticular in cross section and has a crankpin-receiving aperture 31 radially outward from the geometric center G of its cross section into which crankpin CP extends. The apices D and F of lenticular-in-cross section rotary piston R have longitudinally extending apex seal slots 33 which slidably receive flat apex seal plates 35. The radially inner surfaces 37 on rotary piston R defining apex seal slots 33 are preferably inclined at an acute angle relative to the axis of rotor R, and apex seal plates 35 have inclined faces 39 complementary to surfaces 37 so that the apex seal plates 35 are urged by centrifugal force and by fluid pressure both radially outwardly against bore 17 and axially against end section 12 when crankshaft CS revolves. Apex seal plates 35 together with rotary piston R define first and second variable volume chambers C1 and C2 (see FIG. 4) on opposite sides of rotary piston R within bore 17.

The flanks FL1 and FL2 on diametrically opposed sides of lenticular-in-cross section rotary piston R between the apices D and F are generally complementary to the bore cross section. When rotary piston R is in top dead center (TDC) position shown in FIGS. 2 and 4*a* wherein the axis A of crankpin CP coincides with coordinate axis Y above the X axis, the geometric center G of the rotary piston cross section is coincident with the axis C of crankshaft CS; flank FL1 of rotary piston R is closely contiguous the portion of bore 17 intersected by coordinate axis Y above the X axis so that communication between suction port I and discharge port E is blocked and the volume of first chamber C1 is a minimum; and flank FL2 is spaced a maximum distance from the portion of bore 17 intersected by coordinate axis Y below the X axis so that the volume of chamber C2 is maximum. After 180° rotation of crankshaft CS from the position shown in FIGS. 2 and 4*a* to the bottom dead center (BDC) position shown in FIG. 4*d* wherein the axis A of crankpin CP coincides with coordinate axis Y below the X axis, the geometric center G of the rotary piston cross section is again coincident with the axis C of crankshaft CS, but flank FL2 is now closely contiguous the portion of bore 17 intersected by axis Y above the X axis so the volume of chamber C2 is minimum, and flank FL1 is spaced a maximum distance from the portion of bore 17 intersected by axis Y below the X axis so that the volume of second chamber C1 is maximum.

It may be considered that the apices D and F of rotary piston R remain in substantially continuous sliding contact with the surface of bore 17 in all positions of rotary piston R, and such continuous engagement is accomplished without the necessity of the phasing gears required in prior art rotary piston, variable volume devices. Although the apex seal plates 35 physically contact the bore 17, the radial movement of apex seal plates 35 within slots 33 is so minute that such seal plates may be regarded as forming the tips (i.e., the apices) of rotary piston R which track along the surface of bore 17. Crankarm CA is the sole force transmitting means between rotary piston R and crankshaft CS. Rotary piston R revolves in a one-to-one ratio with crankshaft CS, and the apices D and F of rotary piston R in sliding contact with bore 17 cam rotary piston R as it is turned by crankarm CA so that rotary piston R rocks, or pivots about crankpin CP through a limited angle (relative to the radius emanating from crankshaft axis C through crankpin axis A) as rotary piston R revolves within bore 17. Although the apex seal plates 35 which physically touch the bore 17 are not urged radially outward by springs, such apex seal plates 35 exert sufficient force through the fluid to cam rotary piston R into pivotal movement about crankpin CP and maintain the longitudinal axis DF of the rotary piston cross section perpendicular to a "reference diameter" in all positions of the rotor.

The term reference diameter is used in the specification and the appended claims to connote the diameter of the bore cross section (and that of closed curve U shown in FIGS. 4 and 5 defining the bore cross section) which intersects the center O of the curve, the geometric center G of the rotary piston cross section, and the axis A of crankpin CP as the rotary piston revolves within bore 17. In accordance with the invention, the apices D and F at opposite ends of the longitudinal axis DF of the rotary piston cross section are in substantially continuous sliding contact with bore 17 in all positions of rotary piston R and so cam rotary piston R that longitudinal axis DF remains perpendicular to the reference diameter in all positions of the rotary piston R and also so that the rotary piston moves so that the geometric center G of the rotary piston cross section travels in a disection of the reference diameter as the rotary piston R revolves and thereby varies the volume of first and second chambers C1 and C2.

Figures 1, 2, 3:
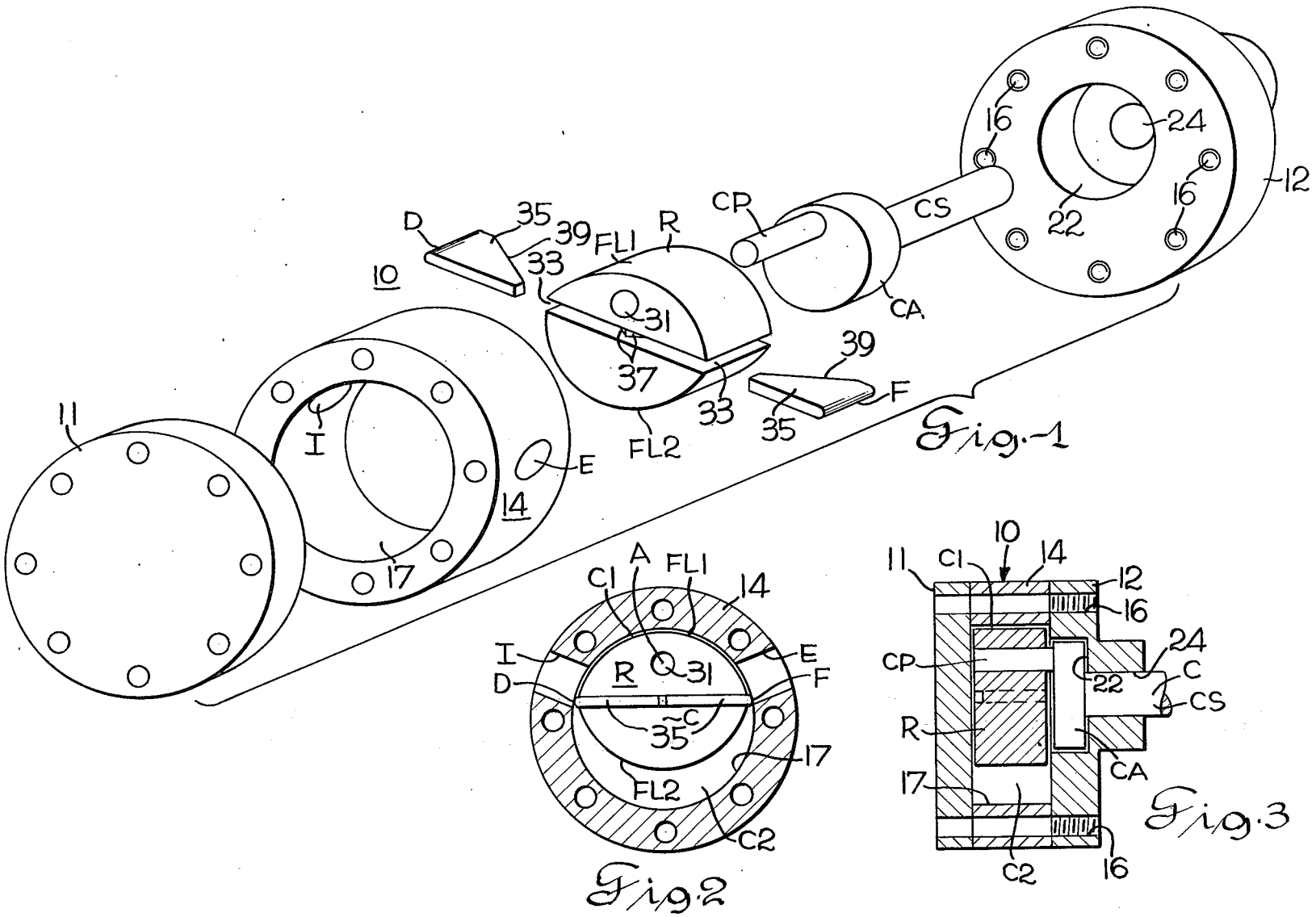
FIG. 1 is an exploded view of a rotary pump embodiment of my invention.
FIG. 2 is a cross section view taken radially through the assembled rotary pump of FIG. 1.
FIG. 3 is a view taken axially through the assembled rotary pump of FIG. 1.
Figure 4:
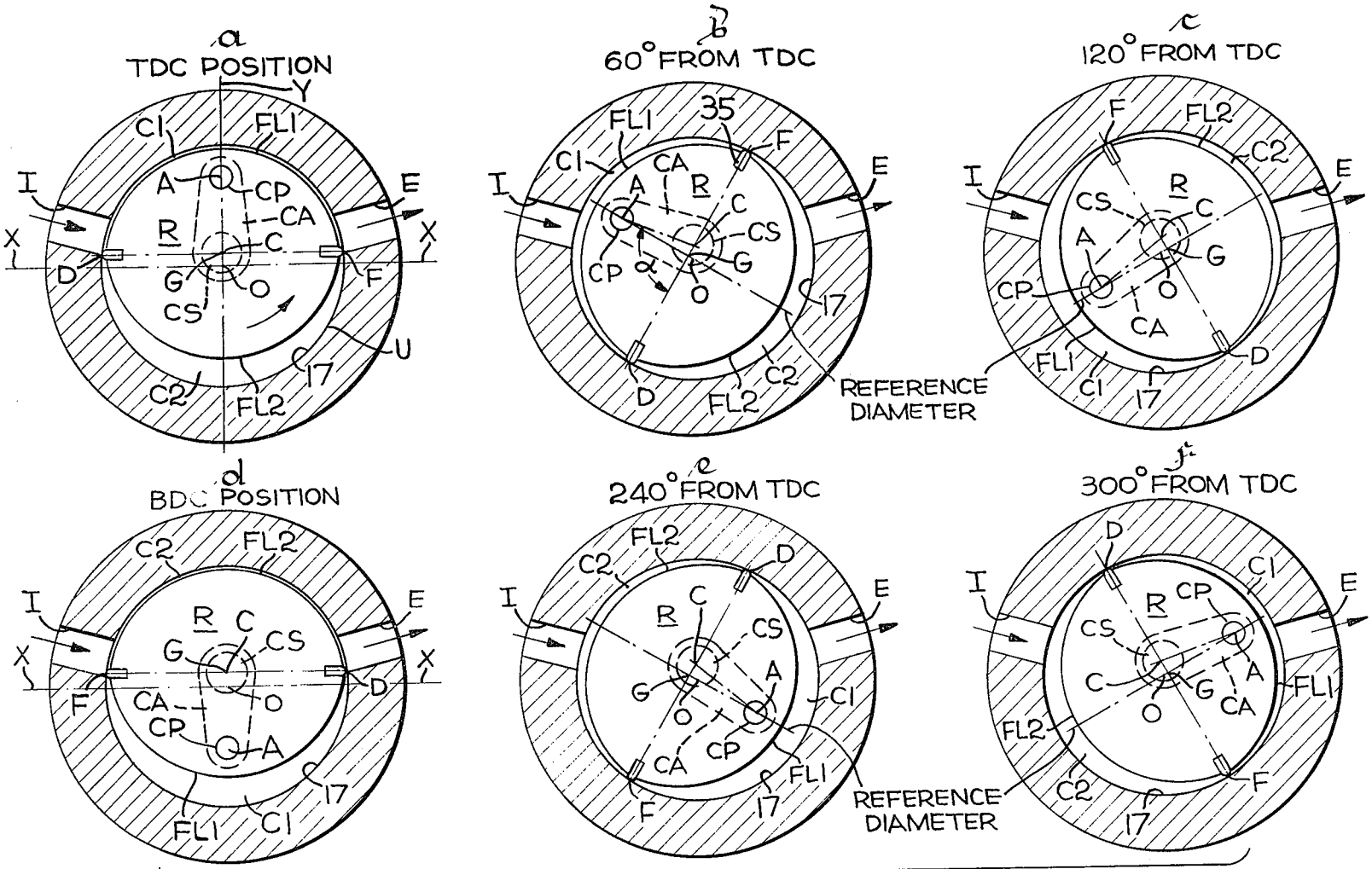
FIGS. 4*a* to 4*f* are schematic views respectively showing successive positions of the rotary piston of the pump of FIG. 1 spaced 60° apart as it rotates counterclockwise within the cylindrical bore.

FIGS. 4*a*–4*f* schematically illustrate successive rotary piston positions spaced 60° apart as rotary piston R revolves in a counterclockwise direction together with crankshaft CS in bore 17. Crankarm CA is shown as a radially extending member rather than circular as depicted in FIGS. 1–3.

FIG. 4*a* illustrates the top dead center (TDC) position of crankarm CA wherein the first variable volume chamber C1 (as defined by flank FL1 and apices D and F) communicates with both suction port I and discharge port E and has minimum volume. The axis A of crankpin CP intersects the Y coordinate axis; flank FL1 of rotary piston R is closely contiguous bore 17 and substantially blocks communication between inlet port I and discharge port E; the geometric center G of the lenticular cross section is coincident with the axis C of crankshaft CS, and crankarm CA is perpendicular to longitudinal axis DF connecting apices D and F. The second variable volume chamber C2 is substantially isolated from the suction port I and discharge port E; flank FL2 has maximum spacing from bore 17 so second chamber C2 is substantially closed and has maximum volume and has inducted fluid therein; and the pressures on the fluid in second chamber C2 are substantially atmospheric. The reference diameter (OGA) intersects the geometric center G of the lenticular cross section (which center G coincides with the axis C of crankshaft CS) and is perpendicular to longitudinal axis DF.

FIG. 4*b* shows rotary piston R after 60° counterclockwise rotation of crankshaft CS from TDC to a position wherein apex F and seal 35 have moved past discharge port E so that fluid is being inducted into first chamber C1 and fluid in chamber C2 is being discharged from exhaust port E. Rotary piston R has pivoted, or rocked about crankpin CP relative to crankarm CA as it revolves with crankshaft CS, as indicated by the fact that the longitudinal axis DF connecting the apices D and F has an acute angle $\alpha$ relative to crankarm CA (instead of being perpendicular thereto as in TDC position) and also by the fact that the geometric center G of the lenticular cross section no longer coincides with crankshaft axis C. Apices D and F remain in continuous sliding engagement with bore 17 and have cammed rotary piston R so that geometric center G has reciprocated along the reference diameter OGA and also so that longitudinal axis DF connecting apices D and F remains perpendicular to the reference diameter as shown in FIG. 4*b*. Rotary piston R has reciprocated along reference diameter OGA (as it simultaneously revolves within bore 17 and rocks relative to crankarm CA) so that the volume of first chamber C1 has increased and the volume of second chamber C2 has decreased.

FIG. 4*c* shows rotary piston R after 120° counterclockwise rotation of crankshaft CS from TDC to a position wherein first chamber C1 is still inducting fluid through suction port I and is approaching maximum volume and second chamber C2 is approaching minimum volume and is discharging fluid from exhaust port E. Rotary piston R has rocked further about crankpin CP. Apices D and F remain in continuous sliding engagement with bore 17 and have cammed rotary piston R as it revolved with crankarm CA so that geometric center G has reciprocated further along reference diameter OGA and also so that longitudinal axis DF remains perpendicular to reference diameter OGA. The simultaneous rocking and reciprocation of rotary piston R as it revolved with crankshaft CS has further increased the volume of first chamber C1 and further decreased the volume of second chamber C2.

FIG. 4*d* shows the bottom dead center (BDC) position of crankarm CA after 180° counterclockwise rotation of crankshaft CS from TDC. At BDC both suction port I and exhaust port E communicate with second chamber C2 and flank FL2 is contiguous the portion of bore 17 intersected by the Y coordinate axis above the X axis so that communication between ports E and I is substantially blocked and the volume of second chamber C2 is minimum. The geometric center G again coincides with the crankshaft axis C and rotary piston R has reciprocated further along the reference diameter. Apices D and F remain in continuous engagement with bore 17 and have cammed rotary piston R, as it revolved with crankshaft CS, so that it has pivoted about crankpin CP until crankarm CA is again perpendicular to longitudinal axis DF which remains perpendicular to the reference diameter. Apex F sweeps past suction port I as crankshaft CS rotates rotary piston R to the BDC position shown in FIG. 4*d* so that first chamber C1 is substantially closed at crankshaft BDC and the fluid is fully inducted therein.

Apex D sweeps past discharge port E as crankshaft CS rotates to the 240°-from-TDC position shown in FIG. 4*e* wherein fluid is being inducted through suction port I into second chamber C2 and the fluid in first chamber C1 is being discharged out of exhaust port E. Apices D and F remain in sliding engagement with bore 17 and have cammed rotary piston R so that it has pivoted about crankpin CP until crankarm CA makes an acute angle relative to the longitudinal axis DF and also so that geometric center G has reciprocated along the reference diameter until flank FL2 has receded away from bore 17 to increase the volume of chamber C2 and flank FL1 has approached closer to bore 17 so that the volume of chamber C1 has decreased. Longitudinal axis DF remains perpendicular to the reference diameter.

At the 300°-from-TDC position shown in FIG. 4*f*, apex D is approaching suction port I and the last portion of the fluid is being displaced from first chamber C1 through discharge port E as rotary piston R again approaches the TDC position. Apices D and F are in sliding engagement with bore 17 and have cammed rotary piston R so that it has pivoted further about crankpin CP and also so that geometric center G has reciprocated along the reference diameter to displace flank FL2 further from bore 17 and thereby increase the volume of chamber C2 and also to move flank FL1 closer to bore 17 and thereby decrease the volume of chamber C1. As rotary piston R revolves, longitudinal axis DF remains perpendicular to the reference diameter OGA.

Chambers C1 and C2 vary in volume from minimum to maximum and back to minimum during each revolution of crankshaft CS. The variation in chamber volume, which establishes the volumetric displacement of the pump, is a function of the eccentricity, or displacement of crankshaft axis C from center O and becomes greater when such eccentricity increases.

FIG. 5 illustrates the development of the closed, generally elliptical curve U along which the rotary piston apices D and F "track" as rotary piston R rotates with crankshaft CS. It will be appreciated that generally elliptical curve U is analogous to the circular cross section of bore 17 of the embodiment of FIGS. 1–4 so that apices D and F remain in continuous engagement with the surface defining bore 17 and so that nearly zero radial movement of the apex seals 35 occurs. Curve U as shown in FIG. 5 is generally elliptical instead of being circular as in the embodiment of FIGS. 1–4, and the coordinate axes X and Y comprise the major and minor axes respectively of elliptical curve U which intersect at the center O of the curve. The axis C of crankshaft CS is offset from center O along the minor axis Y. The length of the chord of curve U perpendicular to the minor axis Y through the crankshaft axis C (and which is coincident with the longitudinal axis DF of the rotary piston cross section) is equal to the diameter of curve U along the minor axis Y.

Rotary piston R is shown in dashed lines at the TDC position wherein the geometric center G of its lenticular cross section is coincident to crankshaft axis C; rotary piston flank FL1 is closely contiguous curve U; and apices D and F of rotary piston R are at opposite ends of longitudinal axis DF and are separated by a distance equal to the diameter of curve U along minor axis Y.

Assume that an imaginary right plane triangle ADG whose base DG is equal to approximately twice its altitude GA is pivotally connected at the vertex A (which is analogous to and given the same designation as the crankpin axis) opposite its base to the radially outer end of an imaginary constant radius link CA (which is analogous to and given the same designation as the crankarm) whose length is substantially equal to altitude GA and whose center of rotation C is offset from the center O along coordinate axis Y. Assume further that triangle ADG is rotated with imaginary link CA so that altitude GA remains coincident with a rotatable reference diameter OGA which passes through center O in all positions of imaginary link CA as the link rotates. During one complete revolution of imaginary link CA together with triangle ADG, the locus of points traced by triangle vertex D is the generally elliptical curve U whose diameter HI along minor axis Y is twice the length of the base DG of triangle ADG.

Triangle ADG is shown in full lines at the TDC position in FIG. 5. This same triangle is shown in dashed lines and designated D'G'A' after 60° counterclockwise rotation of imaginary link CA' from TDC and is also shown in dot-dash lines and designated D''G''A'' after 315° counterclockwise revolution of the imaginary link from TDC.

Now if an isoceles triangle ADF whose altitude GA is equal to that of triangle ADG and whose base DF has a length equal to twice that of triangle ADG is pivotally connected to imaginary link CA at vertex A, and if vertex D of isoceles triangle ADF is moved along locus of points U, then the other vertex F of isoceles triangle ADF will also be in substantially continuous contact with the generally elliptical curve U at all positions of imaginary link CA.

It will be appreciated that crankarm CA of the embodiment of FIGS. 1–4 is analogous to the imaginary link CA with the crankpin axis at triangle vertex A; that the center of rotation of imaginary link CA is analogous to the axis C of crankshaft CS; and also that isoceles triangle base DGF is congruent with longitudinal axis DF of the rotary piston cross section connecting apices D and F. Consequently, the path, or locus of points traced by apices D and F as rotary piston R revolves together with crankshaft CS is the generally elliptical curve U. Stated in another way, the apices D and F of lenticular-on-cross section rotary piston R track along the closed curve U as rotary piston R is rotated by crankarm CA, and consequently apices D and F remain in substantially continuous sliding contact with bore 17 in all positions of rotary piston R since curve U defines the cross section of bore 17 and, further, nearly zero radial movement of apex seals 35 occurs as rotor R rotates. The apices D and F in sliding contact with bore 17 so cam rotary piston R as to accomplish the equivalent result of maintaining triangle altitude GA (and G'A' and G''A'') congruent to the reference diameter intersecting center O, vertex A, and geometric center G, and consequently the geometric center G reciprocates along this reference diameter and the longitudinal axis DF connecting rotary piston apices D and F remains perpendicular to this reference diameter AGO (which also assumes the A'G'O' and A''G''O'' positions) in all positions of rotary piston R within bore 17.

I have found that when the crankshaft axis C is offset along minor axis Y from center O by approximately 5 percent of the length of the bore diameter along the minor axis, the locus of points traced by rotary piston apices D and F is nearly a circle. Further, when the crankshaft axis C is offset along minor axis Y from center O by approximately ten percent of the length of the bore diameter along the minor axis Y, the locus of points traced by rotary piston apices D and F is a generally elliptical curve whose diameter along the major axis X is approximately 102 percent of the diameter along the minor axis Y. When the cross section of bore 17 is the generally elliptical curve U and crankshaft axis C is offset from center O by approximately 10 percent of the bore diameter along the Y axis, the rotary piston apices D and F remain in substantially continuous engagement with the bore in all rotary piston positions and substantially no movement of the apex seals 35 occurs.

Figure 6:
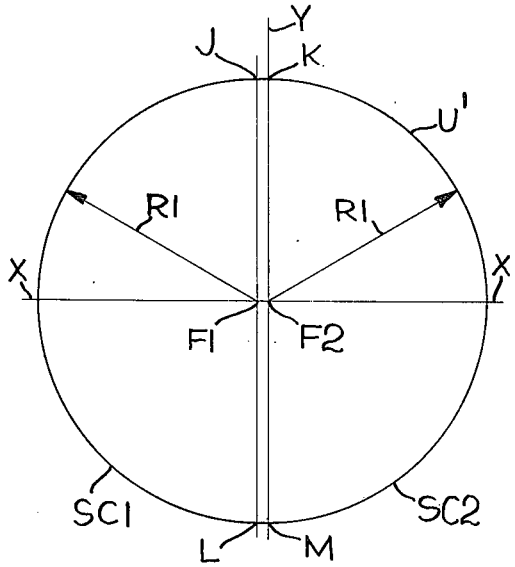
FIG. 6 illustrates the cross section of the cylindrical bore of an alternative embodiment which substantially incorporates the theoretical development illustrated in FIG. 5.

The theoretical locus U traced by triangle vertex D approaches the contour of a circle and is closely approximated by the "obround" configuration U′ illustrated in FIG. 6 showing two points F1 and F2 spaced apart along major axis X and which are the centers of semicircles SC1 and SC2 of equal radius R1 and which semicircles SC1 and SC2 are interconnected by straight portions JK and LM tangential to both semicircles.

Figure 7:
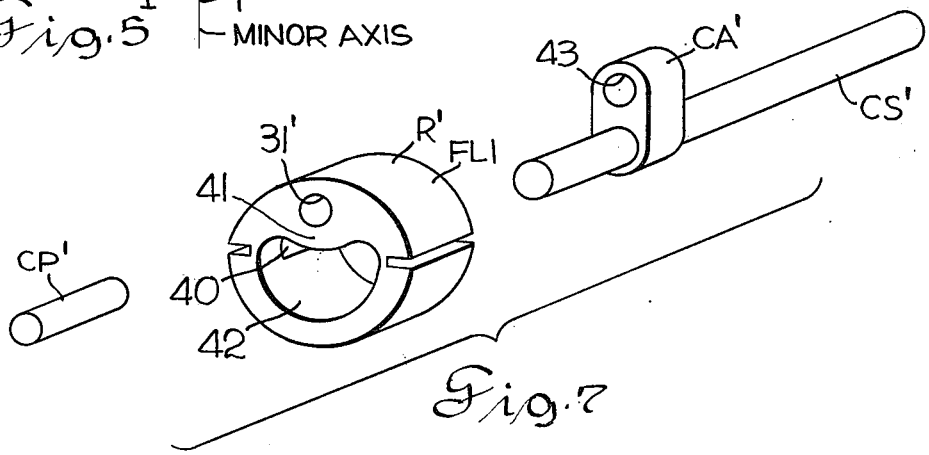
FIG. 7 is an exploded view of an alternative construction of rotary piston and crankshaft for the rotary pump embodiment of FIG. 1.
Figure 9:
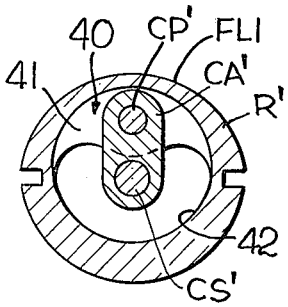
FIG. 9 is a view taken along line IX—IX of FIG. 8.
Figure 8:
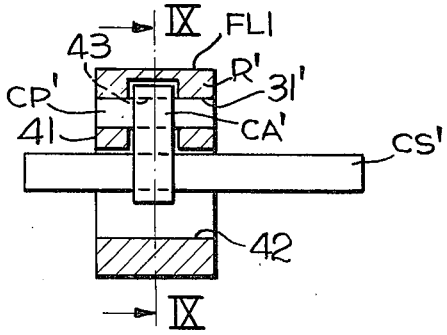
FIG. 8 is a view taken axially through the assembled rotary piston and crankshaft of FIG. 7.

FIGS. 7, 8 and 9 illustrate an alternative construction of rotary piston and crank for the positive displacement pump embodiment of FIGS. 1–4 but which has a through crankshaft instead of an overhung crankshaft. Elements similar to those of the FIGS. 1–4 embodiment are given the same reference characters but with the prime (′) designation. Rotary piston R′ is lenticular in cross section but is generally hollow and has a central compartment 40 partially defined by end walls 41 having aligned elongated arcuate openings 42 therein through which crankshaft CS′ freely extends. Crankshaft CS′ has an integral, radially extending crankarm CA′ disposed within central compartment 40 in rotary piston R′, and a crankpin CP′ extends through crankpin-receiving apertures 31′ in end walls 41 aligned with a bushing hole 43 in crankarm CA′ to pivotally connect crankshaft CS′ to rotary piston R′ so that crankshaft CS′ swings freely within arcuate openings 42 and crankarm CA′ moves freely within compartment 40. Bushing holes 31′ communicate with compartment 40 and are adjacent flank FL1 so that rotary piston R′ is pivotally connected to crankarm CA′ at a point removed in a radial direction from the geometric center of the rotary piston cross section. It will be appreciated that the crankarm-receiving compartment 22 in one housing end section of the FIGS. 1–4 embodiment is omitted in this embodiment and further that both housing end sections (not shown) have openings for journalling the ends of through crankshaft CS′ in a manner analogous to the embodiment of FIGS. 10–11. The through crankshaft CS′ of the FIGS. 7–9 embodiment has greater rigidity than the overhung crankshaft and finds particular utility in high pressure pump embodiments of my invention and also in internal combustion engine embodiments wherein a combustible charge is introduced into the central compartment 40 in the rotary piston.

Figures 10, 11:
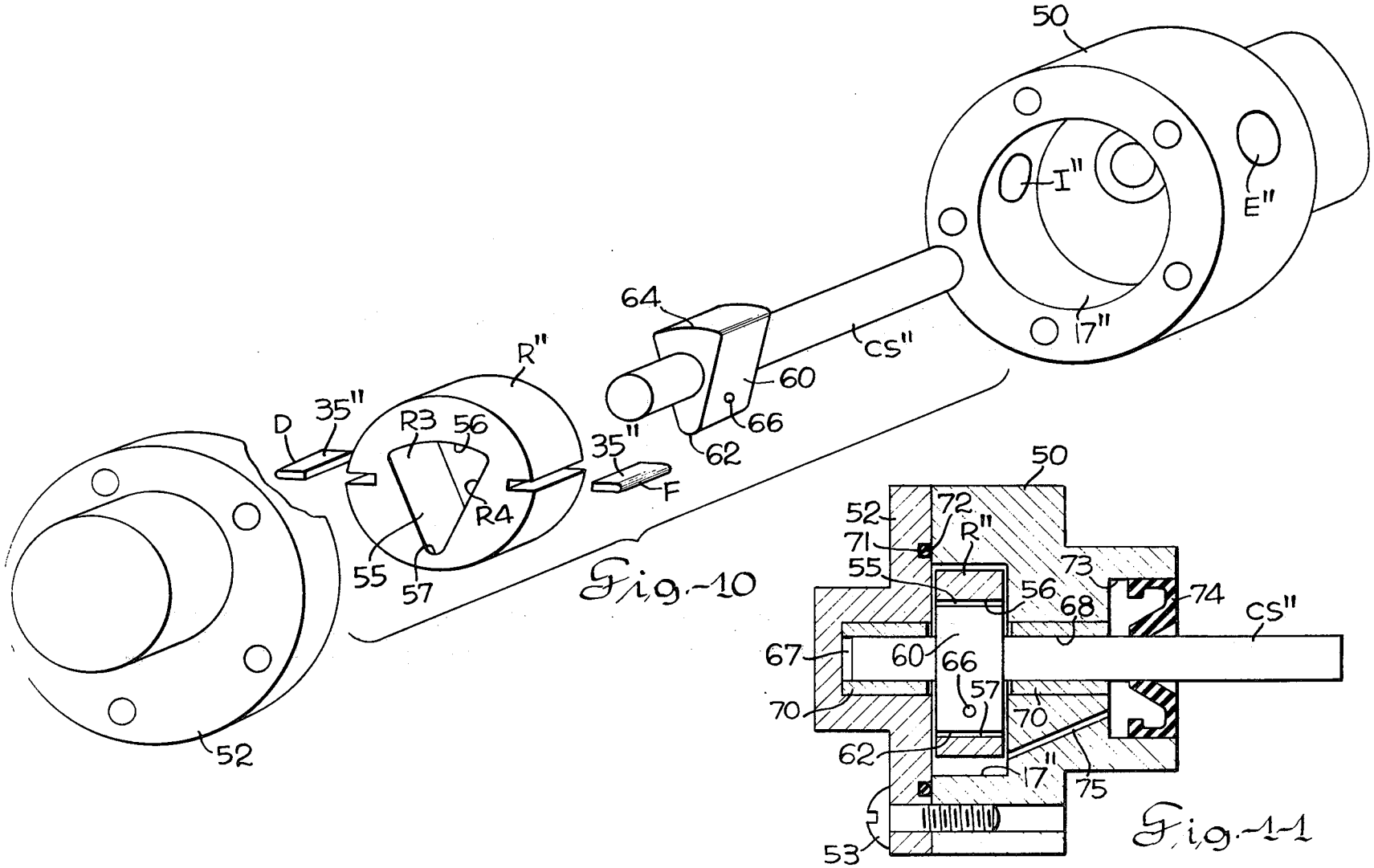
FIG. 10 is an exploded view of an alternative rotary pump embodiment of the invention.
FIG. 11 is a view taken axially through the assembled rotary pump of FIG. 10.

FIGS. 10 and 11 illustrate an alternative embodiment of positive displacement rotary pump wherein the force transmitting means between crankshaft and rotary piston eliminates a crankpin. Elements similar to those of the FIGS. 1–4 embodiment are given the same reference characters with the double prime (″) designation. A generally cylindrical pump housing 50 has a compartment in one end face defining a cylindrical bore 17″ whose cross section is in accordance with closed curve U described hereinbefore. Housing 50 also has an inlet port I″ and an exhaust port E″ communicating with bore 17″, and housing 50 is closed by an end plate 52 secured thereto by screws 53. Rotary piston R″ is of lenticular cross section and has an opening 55 therethrough of generally sector-shaped cross section defined by two diverging radial wall portions R3 and R4 which at their diverging ends intersect an arcuate wall portion 56. Adjacent their converging ends radial wall portions R3 and R4 merge into a rounded, generally semicircular bearing wall portion 57 which defines the area of driving connection between crankarm 60 and rotary piston R″ and is disposed radially outward from the geometric center of the cross section of rotary piston R″. An elongated through crankshaft CS″ protrudes freely through opening 55 and has an integral motion transmitting crankarm 60 of sector-shaped cross section positioned within rotary piston opening 55. Sector-shaped crankarm 60 has a rounded force transmitting tip 62 adjacent its narrow end in abutting relation with bearing wall portion 57 of rotary piston R″, and at its wider end crankarm 60 has an arcuate portion 64 slidable along arcuate wall portion 56 of rotary piston opening 55.

The sector defining the cross section of opening 55 subtends a substantially greater central angle than that subtended by the sector defining the cross section of crankarm 60 so that crankarm 60 is free to pivot within rotary piston opening 55 while rotary piston R″ and crankshaft CS″ rotate together in a one-to-one ratio within bore 17″. The rounded tip 62 of crankarm 60 pivots within arcuate wall portion 57 of rotor R″ to provide a force transmitting connection therebetween without the crankarm 60 engaging the radial wall portions R3 and R4 of rotary piston opening 55 and while permitting rotary piston R″ to pivot relative to crankarm 60 as rotary piston and crankshaft turn together. The arcuate portion 64 of crankarm 60 slides along arcuate wall portion 56 of rotary piston opening 55 as rotary piston R″ pivots relative to crankarm 60 to prevent radial movement of rotary piston R″ relative to the axis of crankshaft CS″ and to force rotary piston R″ to maintain the same point of pivotal connection with crankarm 60. An aperture 66 is provided through crankarm 60 to prevent force transmission by fluid which might otherwise be compressed between crankarm 60 and radial wall portions R3 and R4. The apices D and F of rotary piston R″ as defined by seals 35″ remain in continuous sliding engagement with bore 17″ and so cam rotary piston R″ as it rotates with crankshaft CS″ that the longitudinal axis DF of the rotary piston cross section remains perpendicular to the reference diameter intersecting the bore cross section curve center O, the geometric center of the cross section of rotary piston R″, and the point of pivotal connection between rotary piston R″ and crankarm 60 (which may be considered to be at the center of arcuate wall portion 57) for all positions of rotary piston R″ within bore 17″.

End plate 52 has a closed end, shaft-receiving opening 67, and housing 50 has a shaft-receiving opening 68 coaxial with opening 67. The axis of openings 67 and 68 is parallel to but offset from the axis of bore 17″, and bearings 70 are positioned in openings 67 and 68 for journalling the ends of crankshaft CS″. End plate 52 has an annular groove 71 surrounding opening 67 in which a resilient sealing gasket 72 is compressed to prevent leakage in a radial direction between housing 50 and end plate 52. The end face of the reduced diameter end of housing 50 has a circular recess 73 in which an annular resilient seal 74 is positioned to prevent leakage of fluid between crankshaft CS'' and housing 50. A small hole 75 in housing 50 connects bore 17'' to recess 73. Approximately atmospheric pressure exists within the variable volume chamber at the BDC position of rotary piston R''.

Figures 12, 13:
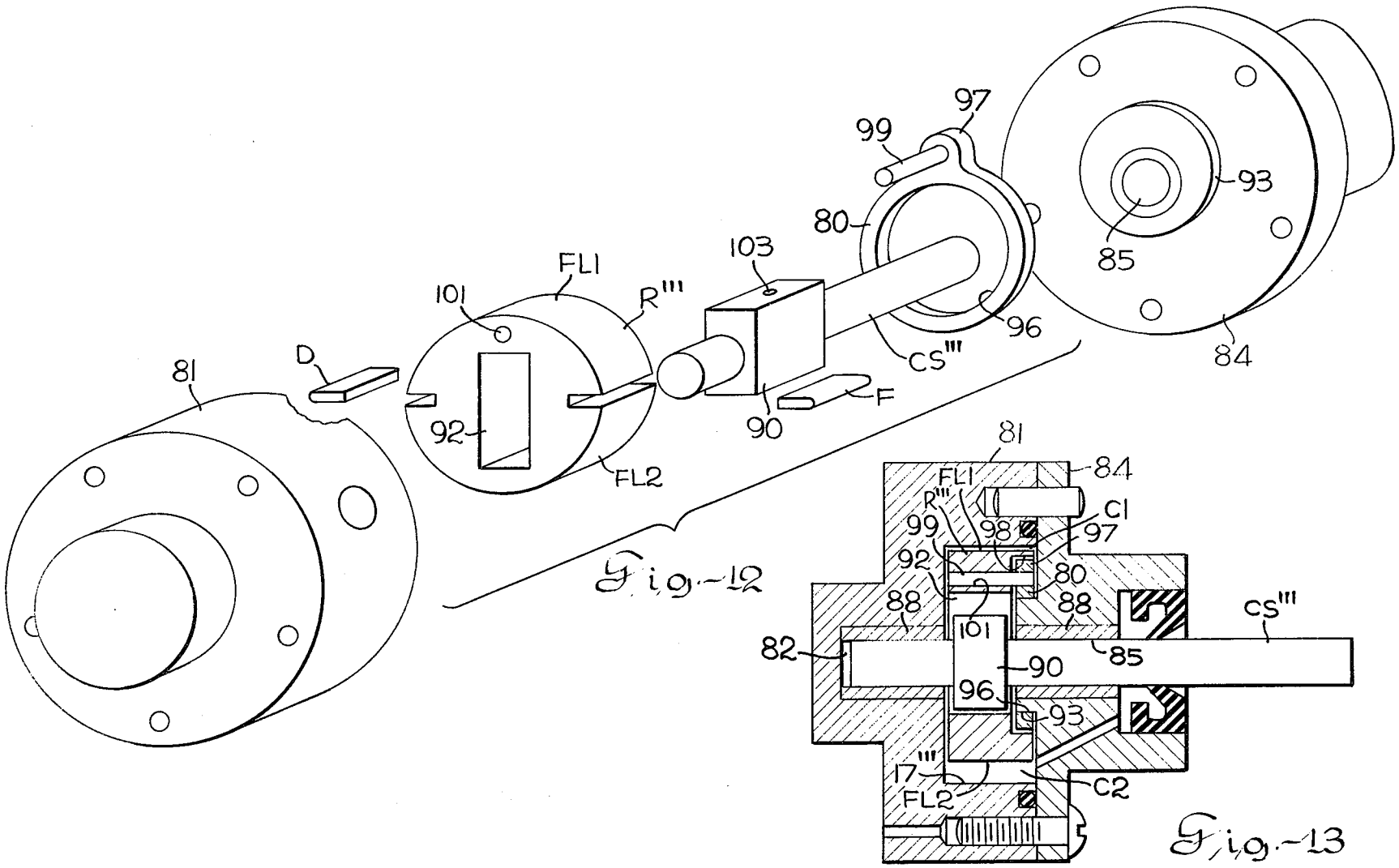
FIG. 12 is an exploded view of an alternative pump embodiment of the invention wherein crankshaft and rotary piston are coaxial and a phasing link displaces the rotary piston.
FIG. 13 is a cross section view taken axially through the embodiment of FIG. 12.

The embodiments disclosed in FIGS. 1–4 and 6–11 are internal cam-engagement type rotary piston expansible chamber devices wherein the bore cams the apices of the rotary piston so that the longitudinal axis of the rotary piston cross section remains perpendicular to a reference diameter extending through the center of the bore cross section curve in all rotary piston positions and the crankarm is the sole force transmitting means between crankshaft and rotary piston. FIGS. 12 and 13 illustrate a rotary piston expansible chamber device embodiment of the invention wherein the bore cross section is in accordance with curve U described hereinbefore and a phasing link 80 constrains the rotary piston R''' so that its apices D and F remain in continuous sealing contact with bore 17''' as rotary piston R''' revolves. Components similar to those of the FIGS. 1–4 embodiment are given the same reference characters with the triple prime (''') designation.

Housing 81 has a closed end, shaft-receiving hole 82 therein coaxial with bore 17''', and end plate 84 has a shaft-receiving aperture 85 coaxial with hole 82 in housing 81. Crankshaft CS''' is rotatably journalled in bearings 88 disposed in hole 82 and aperture 85 for rotation about the axis through the center O of the closed curve U defining the cross section of cylindrical bore 17'''. Crankshaft CS''' has an integral driving, or force-transmitting crankarm 90 of rectangular cross section intermediate its ends. Rotary piston R''' is of lenticular cross section and has an opening 92 therethrough of rectangular cross section which freely receives driving crankarm 90 so that crankshaft CS''' rotates together with rotary piston R''' in a one-to-one ratio while permitting rotary piston R''' to move radially of crankshaft CS''' in the manner of a Scotch yoke.

End section 84 has an integral circular bearing, or camming surface 93 which surrounds aperture 85 and crankshaft CS''' and has its center offset along the minor axis Y from the axis of bore 17''' so that circular bearing surface 93 is eccentric to the axis of rotation of crankshaft CS'''. Phasing link 80 has a ring-shaped journal portion 96 that surrounds and rotates about bearing surface 93 and also has a radially extending arm portion 97. One axial-facing surface of rotary piston R''' has a recess 98 which freely receives phasing link 80 so that phasing link 80 can move freely relative to rotary piston R'''. A coupling pin 99 carried by phasing link arm portion 97 protrudes into an aperture 101 in rotary piston R''' at a point radially outward from the geometric center of the rotary piston cross section. Coupling pin 99 pivotally connects rotary piston R''' to phasing link 80.

Rotation of crankshaft CS''' results in turning of rotary piston R''' through the positive engagement between rectangular driving member 90 with the complementary opening in rotary piston R''' and also causes rotation of phasing link 80 about circular camming surface 93 which is eccentric to the crankshaft axis, thereby causing rotary piston R''' to simultaneously pivot about coupling pin 99 so that the rotary piston cross section longitudinal axis DF remains perpendicular to the reference diameter through the center O of the bore cross section curve and through the geometric center of the rotary piston cross section and also through the axis of coupling pin 99 in all rotary piston positions. Phasing link 80 also causes the geometric center of the rotary piston cross section to reciprocate along the reference diameter as crankshaft CS''' revolves to thereby vary the volume of the chambers C1 and C2 formed between the rotary piston flanks FL1 and FL2 and bore 17''' as crankshaft CS''' revolves.

A bypass hole 103 through crankarm 90 prevents transmission of force against rotary piston R''' in a radial direction as a result of fluid that might otherwise be compressed between crankarm 90 and rectangular recess 92 in rotary piston R'''.

Figure 14:
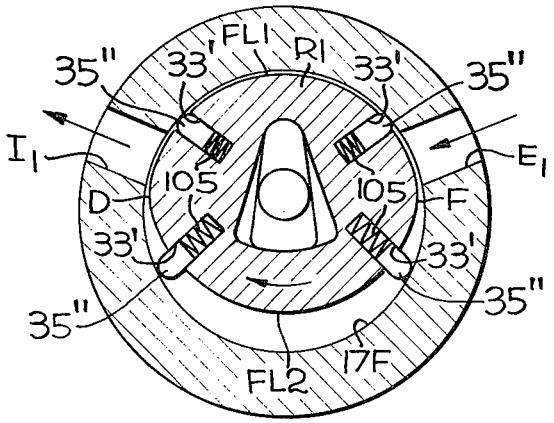
FIG. 14 is a cross section view taken radially through a fluid motor embodiment of the invention.

FIG. 14 is a cross sectional view through a fluid motor embodiment of the invention which is similar in construction to the rotary pump embodiment of FIGS. 10 and 11 but with a modified sealing arrangement. The seal slots of the pump embodiments are omitted at the apices D and F of the lenticular cross section rotary piston $R_1$. The apices D and F of the rotary piston $R_1$ are directly cammed by the bore 17F so that the longitudinal axis of the rotary piston cross section remains perpendicular to the reference diameter. A pair of arcuately spaced seal slots 33' are provided on opposite sides of apex D which receive seal plates 35'', and similarly a pair of arcuately spaced seal slots 33' are also provided on opposite sides of apex F in which seal plates 35'' are disposed. Seal plates 35'' are preferably urged radially outward by springs 105 to assure sealing during starting. The arcuate spacing between seal slots 33' at opposite ends of rotary piston $R_1$ is less than that between inlet port $I_1$ and exhaust port $E_1$ so prevent bypassing of high pressure fluid from inlet port $I_1$ to exhaust port $E_1$ when the flanks FL1 and FL2 of the rotary piston $R_1$ are at TDC and BDC positions, which bypassing might otherwise diminish the forces tending to turn rotary piston $R_1$.

Figure 15:
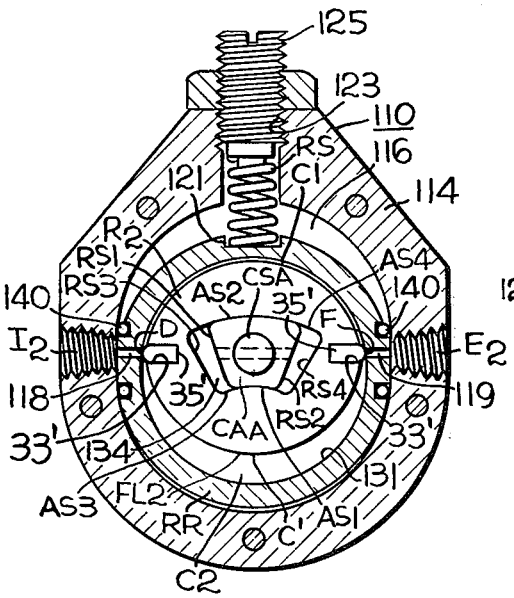
FIGS. 15 and 16 are radial and axial cross section views respectively taken through a pressure compensated, variable volume pump embodiment of the invention wherein the bore is formed in a separate reaction ring rather than directly by the internal wall of the housing.
Figure 16:
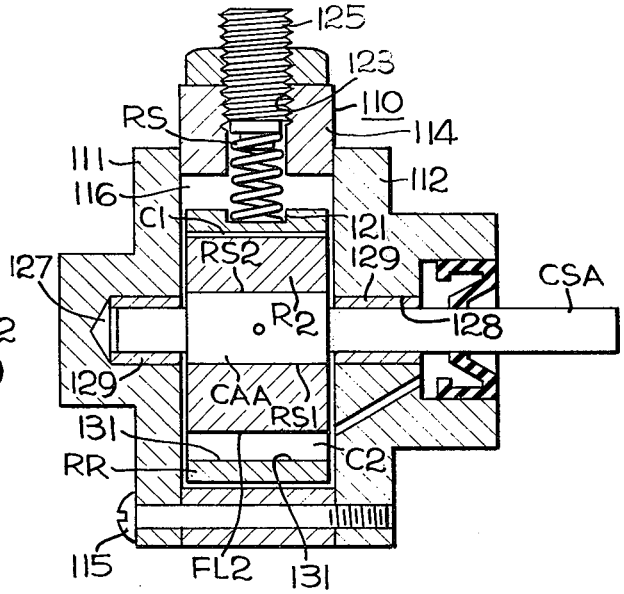

FIGS. 15 and 16 illustrate a pressure compensated, variable volume pump embodiment of the invention whose volumetric displacement, and thus the volume of liquid pumped is dependent upon the pump output pressure. The pressure compensated pump has a housing 110 comprising end sections 111 and 112 and an intermediate section 114 held together by screws 115 in a manner similar to the FIG. 1 embodiment. Intermediate section 114 has an axially extending, cylindrical internal cavity 116, a radially extending inlet port $I_2$ communicating with internal cavity 116, and radially extending discharge port $E_2$ communicating with internal cavity 116. The cross section of internal cavity 116 is generally elliptical and is preferably obround; i.e., defined by two spaced semicircles (not shown) connected by straight line portions. An annular reaction ring RR is positioned within internal cavity 116 and is free to move along the major axis of the elliptical cross section of internal cavity 116. Reaction ring RR has radially extending openings 118 and 119 which register with inlet port $I_2$ and discharge port $E_2$ respectively. One end of a helical reaction spring RS is seated in a cavity 121 in the circumference of reaction ring RR and its other end extends into a radially extending threaded hole 123 in housing 114 and abuts against a pressure adjusting screw 125 engaged in threaded hole 123 to thereby resiliently urge reaction ring RR toward one end of obround internal cavity 116. End housing sections 111 and 112 have coaxial, axially extending apertures 127 and 128 respectively receiving annular bearings 129 in which a crankshaft CSA is rotatably journalled so that it protrudes through reaction ring RR. Crankshaft CSA has an integral four-sided crankarm CAA positioned within reaction ring RR. Crankarm CAA has a pair of opposed arcuate sides AS1 and AS2 drawn from a common center C′ adjacent the flank FL2 of rotary piston $R_2$ and a pair of opposed radial sides RS1 and RS2 defined by radii emanating from common center C′.

Rotary piston $R_2$ is of lenticular cross section and is similar to rotary piston R of the FIG. 1 embodiment and is positioned within reaction ring RR so that its apices D and F have continuous sliding and sealing engagement with the internal wall 131 of reaction ring RR. Internal wall 131 of reaction ring RR performs the camming and sealing function provided by the bore 17 in the FIG. 1 embodiment and is connoted by the term "bore" in the appended claims. Apices D and F of rotary piston $R_2$ have seal slots 33′ which slidably receive seal plates 35′ that engage internal wall 131.

Rotary piston $R_2$ has a four-sided crankarm-receiving aperture 134 whose cross section is similar to that of crankarm CAA so that crankarm CAA is free to slide within aperture 134 and thereby pivotally couple rotary piston $R_2$ to crankshaft CSA for relative movement therebetween as they rotate together within internal wall 131 of reaction ring RR in a one-to-one ratio. Aperture 134 has a pair of opposed arcuate sides AS3 and AS4 drawn from common center C′ and a pair of opposed radial sides RS3 and RS4 which emanate from center C′ but subtend a greater angle than the radial sides RS1 and RS2 of crankarm CAA so that crankarm CAA has limited pivotal movement relative to rotary piston $R_2$. As lenticular rotary piston $R_2$ rotates together with crankshaft CSA within reaction ring RR, it is cammed by apices D and F in sliding engagement with internal wall 131 so that the flanks on opposite sides of rotary piston $R_2$ approach toward and recede away from internal wall 131 in reaction ring RR and thereby change the volume of the variable volume chambers C1 and C2 formed between rotary piston $R_2$ and internal wall 131 in the same manner as the other embodiments wherein the bore is defined by the internal walls of the housing.

Reaction spring RS seated within cavity 121 prevents turning of reaction ring RR within internal elliptical cavity 116 but urges reaction ring RR to a maximum volumetric displacement (minimum output pressure) position against one end of internal cavity 116 wherein the axis of crankshaft CSA is offset from the axis of reaction ring RR along the longitudinal axis of elliptical internal cavity 116. The eccentricity between the axes of crankshaft CSA and reaction ring RR is maximum in the position shown in FIGS. 15 and 16, and consequently the variation between the minimum and maximum volumes of the variable volume chambers C1 and C2 formed on opposite sides of lenticular rotary piston $R_2$ is greatest in this position. Stated another way, the maximum volume is displaced when the pressure head pumped against is minimum.

As the flow of liquid through discharge port $E_2$ is throttled, pressure builds up within the variable volume chambers C1 and C2 formed between rotary piston $R_2$ and reaction ring RR, thereby moving reaction ring RR against the force of reaction spring RS. As reaction ring RR is displaced upward against reaction spring RS, the eccentricity between the axis of crankshaft CSA and reaction ring RR diminishes, thereby reducing the volumetric displacement of the pump. The reaction ring RR moves against the force of reaction spring RS until a state of equilibrium is reached wherein the internal pressure, created by rotary piston $R_2$ being displaced toward internal wall 131, is balanced by the pressure being pumped against. As the load pumped against increases and the axis of reaction ring RR approaches the axis of crankshaft CSA, the reaction ring RR approaches a minimum volumetric displacement position wherein the compression of reaction spring RS is greatest and eccentricity between the axes of reaction ring RR and crankshaft CSA approaches zero.

The external periphery of reaction ring RR preferably has circular depressions surrounding radial openings 118 and 119 in which O-ring gaskets 140 are compressed between reaction ring RR and internal cavity 116 to prevent liquid flowing through the inlet and discharge ports from being bypassed into internal cavity 116.

In alternative embodiments the internal cavity within housing 110 is rectangular and the reaction ring is a member of rectangular cross section slidable within the rectangular cavity in the housing and having a cylindrical internal bore of circular cross section in which the rotary piston rotates. In still other embodiments the inlet and discharge ports extend axially and are in one of the housing end sections 111 or 112 rather than being in intermediate section 114, thereby eliminating port holes 118 and 119 in reaction ring RR, the O-rings 140, and cavity 121.

While only a few embodiments of my invention have been illustrated and described, many modifications and variations thereof will be readily apparent to those skilled in the art, and consequently it should be understood that I do not intend to be limited to the particular embodiments shown and described.

The embodiments of the invention in which an exclusive property or privilege is claimed are defined as follows:

1. A rotary piston expansible chamber device comprising, in combination, a housing (10, FIGS. 1–4) having a cylindrical bore (17) whose cross section is a closed curve (U) with the center (O) at the intersection of first and second rectangular coordinate axes (X, Y), a cylindrical rotary piston (R) rotatable within said bore (17) with its axis parallel to the bore axis and having first and second arcuately spaced apices (D, F) which divide said bore into first and second chambers (C1, C2) on opposite sides of said rotary piston, a shaft (CS) rotatable within said bore about an axis (C) parallel to the bore axis, means including a single force transmitting member (CA) carried by said shaft (CS) for operatively connecting said shaft to said rotary piston (R) so that they rotate together in a one-to-one ratio while concurrently permitting rocking movement of said rotary piston (R) relative to said shaft (CS) and to said force transmitting member (CA) about a surface radially outward from the shaft axis and so that said first and second apices are displaced through different angles than said shaft, and means (17, D, F) for displacing said rotary piston (R) as it revolves together with said shaft (CS) so that said first and second chambers (C1, C2) vary inversely in volume and said first and second apices (D, F) remain in substantially continuous contact with said bore (17) in all positions of said rotary piston R and also so that a straight line (DGF) connecting said first and second apices (D, F) remains perpendicular to a rotatable reference diameter (OGA) through the center (O) of said closed curve (U) in all positions of said rotary piston (R).

2. A rotary piston expansible chamber device in accordance with claim 1 wherein said rotary piston rocks relative to said shaft and said force transmitting member about a surface radially removed from the geometric center of the rotary piston cross section and said means for displacing said rotary piston also actuates said rotary piston so that the geometric center of its cross section reciprocates along said reference diameter as said rotary piston revolves to thereby vary the volumes of said first and second chambers from minimum to maximum and back to minimum during each revolution of said shaft.

3. A rotary piston expansible chamber device in accordance with claim 1 wherein said cylindrical rotary piston is hollow and of one-piece and said shaft extends freely through said rotary piston so that its axis is parallel to that of said rotary piston and so that said force transmitting member is enclosed within the dimensions of said rotary piston in both axial and radial directions, said force transmitting member constituting the sole torque producing means between said shaft and said piston and said piston rocking relative to said shaft and said force transmitting member about a surface radially removed from the geometric center of the rotary piston cross section.

4. A rotary piston expansible chamber device in accordance with claim 1 wherein the axis of said shaft is coincident with the center of said closed curve, said housing has a circular bearing surface whose center is offset along one of said rectangular coordinate axes from said center of said closed curve, and said means for displacing said rotary piston includes a phasing link having a ring-shaped journal which surrounds and rotates about said circular bearing surface, said phasing link being pivotally coupled to said rotary piston at a point radially outward from the geometric center of said rotary piston cross section.

5. A rotary piston expansible chamber device in accordance with claim 4 wherein said rotary piston has an elongated slot therein perpendicular to said straight line connecting said first and second apices and said force transmitting member carried by said shaft is rectangular in cross section and slidably reciprocates within said slot in said rotary piston.

6. A rotary piston expansible chamber device comprising, in combination, a housing (10, FIGS. 1–4) having a cylindrical bore (17) whose cross section is a closed curve (U), a cylindrical rotary piston (R) rotatable within said bore (17) with its axis parallel to the bore axis and having first and second arcuately spaced apices (D, F) which divide said bore into first and second chambers (C1, C2) on opposite sides of said rotary piston, a shaft (CS) rotatable within said bore about an axis (C) parallel to the bore axis, means including a force transmitting crankarm CA integral with and carried by said shaft (CS) for operatively connecting said shaft to said rotary piston (R) so that they rotate together in a one-to-one ratio while concurrently permitting rocking movement of said rotary piston (R) relative to said shaft (CS) and to said crankarm (CA) and so that said first and second apices are displaced through different angles than said shaft, said crankarm being pivotally coupled to said rotary piston at a point radially outward from the geometric center of the rotary piston cross section and constituting the sole force transmitting means between said shaft and said piston, and means (17, D, F) for displacing said rotary piston (R) as it revolves together with said shaft (CS) so that said first and second chambers (C1, C2) vary inversely in volume and said first and second apices (D, F) remain in substantially continuous contact with said bore (17) in all positions of said rotary piston R and also so that a straight line (DGF) connecting said first and second apices (D, F) remains perpendicular to a rotatable reference diameter (OGA) through the center (O) of said closed curve (U) in all positions of said rotary piston (R).

7. A rotary piston expansible chamber device comprising, in combination, a housing (10, FIGS. 1–4) having a cylindrical bore (17) whose cross section is a closed curve (U) with the center (O) at the intersection of first and second rectangular coordinate axes (X, Y), a cylindrical rotary piston (R) rotatable within said bore (17) with its axis parallel to the bore axis and having first and second arcuately spaced apices (D, F) which devide said bore into first and second chambers (C1, C2) on opposite sides of said rotary piston, a shaft (CS) rotatable within said bore about an axis (C) parallel to the bore axis, means including a force transmitting member (CA) carried by said shaft (CS) for operatively connecting said shaft to said rotary piston (R) so that they rotate together in a one-to-one ratio while concurrently permitting movement of said rotary piston (R) relative to said shaft (CS) and to said force transmitting member (CA), means (17, D, F) for displacing said rotary piston (R) as it revolves together with said shaft (CS) so that said first and second chambers (C1, C2) vary inversely in volume and said first and second apices (D, F) remain in substantially continuous contact with said bore (17) in all positions of said rotary piston (R) and also so that a straight line (DGF) connecting said first and second apices (D, F) remains perpendicular to a rotatable reference diameter (OGA) through the center (O) of said closed curve (U) in all positions of said rotary piston (R) and also so that the geometric center of the piston cross section reciprocates along said reference diameter as said rotary piston revolves to thereby vary the volume of said first and second chambers from minimum to maximum and back to minimum during each revolution of said shaft and wherein said rotary piston is pivotally coupled to said force transmitting member and said reference diameter extends through the point of pivotal coupling between said rotary piston and said force transmitting member in all positions of said rotary piston within said bore and said means for displacing said rotary piston rocks said rotary piston relative to said shaft as they rotate together so that said first and second apices are moved through different angles than said shaft.

8. A rotary piston expansible chamber device in accordance with claim 7 wherein the axis of said shaft is offset along one of said coordinate axes from said center of said closed curve and said means for displacing said rotary piston includes the contour of said bore and said first and second apices in continuous sliding and sealing engagement with said bore so camming said rotary piston that said straight line connecting said apices remains perpendicular to said reference diameter and said geometric center reciprocates along said reference diameter.

9. A rotary piston expansible chamber device in accordance with claim 8 for pumping fluid wherein said housing has an inlet port and a discharge port communicating with said bore on opposite sides of said one coordinate axis, both said first and second apices sweep past said inlet port to initiate intake into said first and second chambers respectively during each revolution of said shaft and also sweep past said discharge port to push fluid compressed in said first and second chambers through said discharge port during each revolution of said shaft.

10. A rotary piston expansible chamber device in accordance with claim 7 wherein the axis of said shaft is offset along one of said coordinate axes from said center of said closed curve, said force transmitting member is a crankarm carried by said shaft, said rotary piston is pivotally coupled to said crankarm, and said reference diameter extend through the point of pivotal coupling between said rotary piston and said crankarm in all positions of said rotary piston, said crankarm constituting the sole force transmitting means between said shaft and said rotary piston.

11. A rotary piston expansible chamber device in accordance with claim 10 wherein said rotary piston is pivotally connected to said crankarm by a crankpin and said crankpin is disposed radially outward from the axis of said shaft and pivotally engages said rotary piston at a point radially outward from said geometric center of said rotary piston cross section.

12. A rotary piston expansible chamber device in accordance with claim 10 wherein said rotary piston has an opening therein of sector-shaped cross section and said crankarm is also of sector-shaped cross section and is disposed within said opening with its vertex abutting the vertex of said sector-shaped opening to thereby pivotally engage said crankarm with said rotary piston, said sector-shaped opening subtending a greater arc than said sector-shaped crankarm so that said rotary piston is free to rock relative to said shaft as they rotate together in a one-to-one ratio within said bore.

13. A rotary piston expansible chamber device in accordance with claim 10 wherein said rotary piston has an arcuate opening therein and said crankarm is of arcuate cross section and is freely slidable within said arcuate opening in said rotary piston to pivotally couple said rotary piston to said shaft.

14. A rotary piston expansible chamber device in accordance with claim 13 wherein said arcuate opening in said rotary piston is four-sided with a first pair of opposed, spaced apart sides being arcuate and having a common center and a second pair of opposed, spaced apart sides defined by two radii emanating from said center which intersect said arcuate sides, said crankarm having a cross section similar to that of said four-sided opening but subtending a smaller angle from said center so that said crankarm is free to slide within said four-sided opening and thereby pivotally couple said rotary piston to said shaft while they rotate together in a one-to-one ratio.

15. A rotary piston expansible chamber device in accordance with claim 10 wherein the point of pivotal coupling between said crankarm and said rotary piston is radially outward from the geometric center of the rotary piston cross section.

16. A rotary piston expansible chamber device in accordance with claim 15 wherein said rotary piston has first and second flanks on opposite sides thereof extending between said first and second apices and also has top and bottom dead center positions within said bore wherein said first and second flanks respectively approach into close proximity with a portion of said bore intersected by said one coordinate axis and wherein said geometric center of said rotary piston cross section is substantially coincident with the axis of said shaft in both said top dead center and bottom dead center positions.

17. A rotary piston expansible chamber device in accordance with claim 16 wherein said first and second apices are separated by a distance along said straight line substantially equal to the diameter of said closed curve along said one coordinate axis and said straight line is perpendicular to said one coordinate axis in said top dead center and bottom dead center positions of said rotary piston.

18. A rotary piston expansible chamber device in accordance with claim 16 wherein said rotary piston is of lenticular cross section, the longitudinal axis of said lenticular cross section is congruent with said straight line connecting said first and second apices, and said first and second flanks of said lenticular cross section rotary piston conform closely to the contour of said bore intersected by said one coordinate axis.

19. A rotary piston expansible chamber device in accordance with claim 18 wherein said geometric center of said lenticular rotary piston cross section is at a point along said longitudinal axis of said cross section and said crankarm is pivotally connected to said rotary piston at a point adjacent the outer margin of said lenticular cross section.

20. A rotary piston expansible chamber device comprising, in combination, a housing (10, FIGS. 1–4) having a cylindrical bore (17) whose cross section is a closed curve (U) with its center (O) at the intersection of first and second rectangular coordinate axes (X and Y), said closed curve (U) being defined by the locus of points described by the vertex (D) opposite the larger acute angle (<DGA) of an imaginery plane right angle triangle (AGD) which is pivotally connected at the vertex (A) opposite its base (DG) with the radially outer end of an imaginary rotatable constant radius link (CA) whose center (C) is offset along one of said coordinate axes from said center (O) of said closed curve (U) as said imaginary link (CA) is rotated together with said imaginary triangle (AGD) through one revolution while the altitude (AG) of said triangle (DGA) remains congruent to an imaginary rotatable reference diameter (OGA) of said closed curve (U), a cylindrical rotary piston (R) rotatable within said bore (17) with its axis parallel to the bore axis and having first and second arcuately spaced apices (D, F), a shaft (CS) rotatable within said bore (17) about an axis (C) parallel to the bore axis and being operatively connected to said rotary piston (R) for rotation together therewith in a one-to-one ratio, and means (17, D, F) for displacing said rotary piston (R) as it revolves together with said shaft (CS) so that it rocks relative to said shaft about a surface radially outward from said shaft and said first and second apices (D, F) are moved through different angles than said shaft but remain in continuous sliding contact with said bore (17) in all positions of said rotary piston and so that a straight line (DGF) connecting said first and second apices remains perpendicular to said rotatable reference diameter (OGA) in all positions of said rotary piston (R).

21. A rotary piston expansible chamber device in accordance with claim 20 wherein the axis of said shaft (CS) is coincident the axis of rotation of said imaginary rotatable link (CA).

22. A rotary piston expansible chamber device in accordance with claim 20 wherein the axis (C) of said shaft (CS) is coincident with the axis of rotation of said imaginary link (CA) and said closed curve (U) is generally elliptical and has a smaller diameter along said one coordinate axis (Y) which constitutes its minor axis than along the other coordinate axis (X) which constitutes its major axis, and wherein the distance separating said first and second apices along said straight line (DGF) is approximately equal to the diameter of said closed curve (U) along said minor axis.

23. A rotary piston expansible chamber device in accordance with claim 20 wherein the length of the base (DG) of said imaginary triangle (AGD) is equal to the radius of said bore (17) along said one coordinate axis (Y) and the altitude (AG) of said imaginary triangle (AGD) is equal to approximately one half of the length of its base (DG).

24. A rotary piston expansible chamber device in accordance with claim 23 wherein the altitude (AG) of said imaginary triangle (AGD) is substantially equal to the length of said constant radius imaginary link (CA) and said surface about which said rotary piston rocks relative to said shaft is adjacent the point of pivotal connection between said imaginary triangle (AGD) and said imaginary rotatable link (CA).

25. A rotary piston expansible chamber device in accordance with claim 20 and including a force transmitting member (CA) carried by said shaft (CS) for operatively connecting said rotary piston (R) to said shaft (CS) and constituting the sole force transmitting means between said shaft (CS) and said rotary piston (R), said piston rocking relative to said force transmitting member and to said shaft at the point of pivotal connection between said imaginary triangle (AGD) and said imaginary rotatable link (CA).

26. A rotary piston expansible chamber device in accordance with claim 25 wherein said force transmitting member is a crankarm (CA), the axis of said shaft (CS) is coincident with the axis of rotation of said imaginary rotatable link (CA), said rotary piston rocks relative to said crankarm about a surface radially outward from the geometric center (G) of the rotary piston cross section, and said means for displacing said rotary piston includes the contour of said bore (17) and said first and second apices (D, F) in substantially continuous sliding and sealing contact with said bore so camming said rotary piston (R) that said straight line (DGF) remains perpendicular to said rotatable reference diameter (OGA) and the geometric center (G) of the rotary piston cross section reciprocates along said reference diameter (OGA).

27. A rotary piston expansible chamber device in accordance with claim 26 wherein said rotary piston (R) has an opening therethrough of sector-shaped cross section and said crankarm is also of sector-shaped cross section and is positioned within said opening with its vertex abutting that of said sector-shaped cross section opening to thereby pivotally engage said crankarm with said rotary piston, said sector-shaped opening subtending a greater arc than said sector-shaped crankarm so that said rotary piston is free to rock relative to said shaft as they rotate together in a one-to-one ratio within said bore.

28. A rotary piston expansible chamber device in accordance with claim 26 wherein said rotary piston (R) has a crankpin receiving aperture (31) disposed radially outward from the geometric center (G) of its cross section and said crankarm (CA) carries a crankpin (CP) disposed radially outward from the axis of said shaft (CS) which protrudes into said aperture (31) in said rotary piston (R).

29. A rotary piston expansible chamber device comprising, in combination, a housing (10, FIGS. 1–4) having a cylindrical bore (17) whose cross section is a closed curve (U) with its center (O) at the intersection of first and second rectangular coordinate axes (X and Y), said closed curve (U) being defined by the locus of points described by the vertex (D) opposite the larger acute angle (<DGA) of an imaginary plane right angle triangle (AGD) which is pivotally connected at the vertex (A) opposite its base (DG) with the radially outer end of an imaginary rotatable constant radius link (CA) whose center (C) is offset along one of said coordinate axes from said center (O) of said closed curve (U) as said imaginary link (CA) is rotated together with said imaginary triangle (AGD) through one revolution while the altitude (AG) of said triangle (DGA) remains congruent to an imaginary rotatable reference diameter (OGA) of said closed curve (U), a cylindrical rotary piston (R) rotatable within said bore (17) with its axis parallel to the bore axis and having first and second arcuately spaced apices (D, F), a shaft (CS) rotatable within said bore (17) about an axis (C) coincident with the axis of rotation of said imaginary link and parallel to the bore axis and being operatively connected to said rotary piston (R) for rotation together therewith in a one-to-one ratio, means (17, D, F) for displacing said rotary piston (R) as it revolves together with said shaft (CS) so that said first and second apices (D, F) remain in continuous sliding contact with said bore (17) in all positions of said rotary piston and so that a straight line (DGF) connecting said first and second apices remains perpendicular to said rotatable reference diameter (OGA) in all positions of said rotary piston (R), and wherein said shaft (CS) carries a crankarm (CA) and said rotary piston (R) is pivotally coupled to said crankarm (CA) at the point (A) of pivotal connection between said imaginary triangle (AGD) and said imaginary rotatable link (CA) and said means for displacing said rotary piston (R) rocks said rotary piston (R) relative to said shaft (CS) as they rotate together and said first and second apices (D, F) move through different angles than said shaft (CS).

30. A rotary piston expansible chamber device in accordance with claim 29 wherein said rotary piston (R) has top dead center and bottom dead center positions within said bore (17) in both of which said straight line (DGF) connecting said first and second apices (D, F) is perpendicular to said one coordinate axis (Y) and is congruent with the base (DG) of said imaginary triangle (AGD) and said crankarm (CA) is congruent with said altitude (AG) of said imaginary triangle (AGD).

31. A rotary piston expansible chamber device in accordance with claim 30 wherein said crankarm (CA) is pivotally coupled to said rotary piston (R) at a point (A) radially outward from the geometric center (G) of the rotary piston cross section.

32. A rotary piston expansible chamber device in accordance with claim 31 wherein said rotary piston (R) is lenticular in cross section and the geometric center (G) of its cross section is coincident with the axis of rotation (C) of said imaginary rotatable link (CA) and said shaft (CS) in said top dead center and bottom dead center positions.

33. A rotary piston expansible chamber device in accordance with claim 32 wherein said crankarm (CA) is the sole force transmitting means between said shaft (CS) and said rotary piston (R) and said means for displacing and rocking said rotary piston (R) relative to said shaft (CS) includes said bore (17) and said first and second apices (D, F) in continuous sliding contact with said bore (17) camming said rotary piston so that said straight line (DGF) remains perpendicular to said imaginary reference diameter (OGA) in all positions of said shaft (CS).

34. A rotary piston expansible chamber device having a rotary piston (R, FIGS. 1–4) with arcuately spaced first and second apices (D, F) pivotally coupled to a crankarm (CA) carried by a crankshaft (CS) so that said rotary piston (R) and said crankshaft (CS) rotate together within a cylindrical working chamber (17) wherein the cross section of the working chamber is a closed curve (U) defined by the locus of points described by the vertex (D) opposite the larger acute angle (<DGA) of an imaginary plane right triangle (AGD) whose base (DG) is congruent with a straight line (DGF) connecting said first and second apices (D, F) and which triangle is pivotally connected at the vertex (A) opposite its base (DG) with the radially outer end of an imaginary rotatable constant radius link (CA) which is congruent with said crankarm (CA) and whose center (C) is coincident with the axis of said crankshaft (CS) and offset radially from the center (O) of said closed curve (U) as said imaginary link (CA) is rotated together with said triangle (AGD) through one revolution while the altitude (GA) of said triangle (AGD) remains congruent to a rotatable imaginary reference diameter (OGA) of said closed curve (U) in all positions of said link, the point (A) of pivotal coupling between said imaginary link (CA) and said imaginary triangle (AGD) being coincident with the point of pivotal coupling between said crankarm (CA) and said rotary piston (R), said crankarm (CA) being the sole force transmitting means between said crankshaft (CS) and said rotary piston (R).

35. A rotary piston expansible chamber device in accordance with claim 34 wherein the length of the base (DG) of said imaginary triangle (AGD) is equal to the radius of said closed curve (U) along a diameter thereof extending through the center (C) of said imaginary rotatable link (CA) and the altitude (GA) of said imaginary triangle (AGD) and the radius of the crankcircle of said crankarm (CA) is equal to approximately one half of the length of the base (DG) of said imaginary triangle (AGD).

36. A rotary piston expansible chamber device in accordance with claim 34 wherein said first and second apices (D, F) in sliding contact with said working chamber (17) so cam said rotary piston (R) that it rocks relative to said crankarm (CA) about the point of pivotal coupling between said rotary piston (R) and said crankarm (CA) as said crankshaft (CS) and rotary piston (R) rotate together and varies the volume of first and second chambers (C1, C2) formed between said rotary piston (R) and said working chamber (17) inversely from minimum to maximum and back to minimum during each revolution of said shaft crankshaft (CS).

37. A rotary piston expansible chamber device comprising, in combination, a housing having a cylindrical bore whose cross section is a closed curve, a cylindrical rotary piston rotatable within said bore with its axis parallel to the bore axis and having first and second arcuately spaced apices which divide said bore into first and second chambers on opposite sides of said piston, a shaft rotatably journalled in said housing with its axis parallel to but eccentric from the axis of said bore, motion transmitting means including a crankarm integral with and carried by said shaft for operatively coupling said piston to said shaft so that they rotate together in a one-to-one ratio while concurrently permitting said piston to pivot relative to said crankarm and vary the angle between the longitudinal axis (CA) of said crankarm and the straight line (DF) connecting said first and second apices and also so that said first and second apices remain in substantially continuous contact with said bore in all positions of said piston, said crankarm constituting the sole means for transmitting motion between said shaft and said piston, said motion transmitting means reciprocating said piston, as it rotates together with said shaft, through a distance along the diameter of the bore cross section extending through the axis (C) of said shaft equal to twice the eccentricity between the axes of said shaft and said bore during each revolution of said shaft so that said piston varies the volume of said first and second chambers inversely between maximum and minimum and back to their original volume during each revolution of said shaft.

38. A rotary piston expansible chamber device in accordance with claim 37 wherein said motion transmitting means couples said crankarm to said piston for pivotal movement of said rotary piston relative to said crankarm about a surface (31, FIGS. 1–4; 51, FIGS. 10–11) displaced from the geometric center (G) of the piston cross section in a direction laterally of said straight line (DF) connecting said first and second apices.

39. A rotary piston expansible chamber device in accordance with claim 38 wherein said piston has a crankpin-receiving aperture displaced radially from said geometric center in a direction laterally of said straight line, said crankpin-receiving aperture defines said surface, and said motion transmitting means includes a crankpin carried by said crankarm and extending into said crankpin-receiving aperture.

40. A rotary piston expansible chamber device in accordance with claim 38 wherein said motion transmitting means so couples said piston to said crankarm that the geometric center of the piston cross section is coincident with the axis of said shaft in top dead center and bottom dead center positions wherein said straight line (DF) connecting said apices is perpendicular to said diameter of said bore cross section extending through the axis (C) of said shaft and wherein the volumes of said first and second chambers respectively are minimum.

41. A rotary piston expansible chamber device in accordance with claim 40 wherein said motion transmitting means maintains the distance of said surface from the axis of said shaft constant in all positions of said piston to thereby maintain the radius of the crankcircle of said crankarm constant.

42. A rotary piston expansible chamber device in accordance with claim 41 wherein said piston has a generally sector-shaped aperture therein (55, FIG. 10) and an arcuate wall portion (57) which connects the converging radial sides of said sector-shaped aperture and defines said surface, and said crankarm is generally sector-shaped and extends into said generally sector-shaped aperture in said piston but has a smaller included angle between its radial sides than the included angle between the radial sides of said generally sector-shaped aperture so that crankarm is free to pivot within said generally sector-shaped aperture and thus permit said piston to pivot relative to said crankarm.

43. A rotary piston expansible chamber device in accordance with claim 41 wherein said motion transmitting means maintains said straight line connecting said apices perpendicular to a rotatable reference diameter of the cross section of said cylindrical bore which extends through the axis of said bore cross section in all positions of said piston within said bore.

44. A rotary piston expansible chamber device in accordance with claim 41 wherein the cross section of said rotary piston is generally an ellipse with the major axis of the ellipse coincident with said straight line connecting said apices and with said geometric center of the rotary piston cross section lying along said straight line and said surface displaced from said geometric center along the minor axis of the ellipse.

* * * * *